US007846036B2

(12) United States Patent
Tanaka

(10) Patent No.: US 7,846,036 B2
(45) Date of Patent: Dec. 7, 2010

(54) GOLF PUTTER HEAD

(76) Inventor: Yoshinobu Tanaka, c/o 55Partners Co., Ltd., 9-5 Wakamiyashimo-machi, Sano-shi, Tochigi (JP) 327-0834

( * ) Notice: Subject to any disclaimer, the term of this patent is extended or adjusted under 35 U.S.C. 154(b) by 111 days.

(21) Appl. No.: 12/380,465

(22) Filed: Feb. 27, 2009

(65) Prior Publication Data

US 2009/0275420 A1 Nov. 5, 2009

(30) Foreign Application Priority Data

Feb. 28, 2008 (JP) ..... 2008-047487

(51) Int. Cl.
*A63B 47/02* (2006.01)
*A63B 53/04* (2006.01)

(52) U.S. Cl. ..... 473/286; 473/341

(58) Field of Classification Search ..... 473/286, 473/340–341, 313; 294/19.2
See application file for complete search history.

(56) References Cited

U.S. PATENT DOCUMENTS 3,841,639 A * 10/1974 Werner ..... 473/286
4,976,436 A * 12/1990 Serizawa ..... 473/286
5,102,139 A * 4/1992 Greig ..... 473/286
5,417,426 A * 5/1995 Bayer ..... 473/285
5,485,999 A * 1/1996 Hull et al. ..... 473/286
5,692,968 A * 12/1997 Shine ..... 473/286
D402,724 S * 12/1998 Minami ..... D21/743
D424,145 S * 5/2000 Minami ..... D21/744
7,059,971 B1 * 6/2006 Schmitt ..... 473/285
2008/0207352 A1 * 8/2008 Engel ..... 473/341

FOREIGN PATENT DOCUMENTS

JP U51-114157 A 9/1976

* cited by examiner

*Primary Examiner*—Stephen L. Blau
(74) *Attorney, Agent, or Firm*—Masuvalley and Partners

(57) ABSTRACT

A golf putter head includes an opening, a deflectable plate and a cutout. The opening is located behind a putter face, and is larger than a golf ball. The deflectable plate is coupled to the golf putter head, with a first end of the deflectable plate projecting into the opening. The cutout is located above the deflectable plate, the cutout having a width that is greater than or equal to a width of the deflectable plate.

19 Claims, 2 Drawing Sheets

GOLF PUTTER HEAD

TECHNICAL FIELD

The present invention relates to golf clubs, and specifically, to a golf putter head by which a player can pick up a golf ball while standing up.

BACKGROUND OF THE INVENTION

Japanese Unexamined Utility Model Application Publication No. 51-114157 discloses that an L-shaped elastic plate is formed at an opening and that a nail piece is allowed to freely protrude and retract from an inner surface of the opening by a spring. Furthermore, a golf putter is known which can pick up a golf ball in a cup by applying the elastic plate or the nail piece to the golf ball.

However, conventional putters have a problem that sand or a cake of soil is caught in a gap between the L-shaped elastic plate and the opening. In addition, a slide portion of the nail piece can clog with sand or a cake of soil. As a result, degraded performance of the elastic plate or the nail piece can damage a golf ball. Furthermore, the degraded performance can make it impossible to pick up a golf ball. Accordingly, the present invention provides a golf putter head by which a user can pick up a golf ball easily and surely while standing up without being affected by sand or a cake of soil.

SUMMARY OF THE INVENTION

In accordance with a first aspect of the present invention, a golf putter head includes an opening located behind a putter face, with the opening larger than a golf ball. A deflectable plate is coupled to the golf putter head, with a first end of the deflectable plate projecting into the opening, and a cutout is located above the deflectable plate, the cutout having a width that is greater than or equal to a width of the deflectable plate.

According to the first aspect of the present invention, the golf putter head has a cutout located above the deflectable plate. Therefore, the deflectable plate can function well even though sand or a cake of soil intrudes into the opening. Accordingly, a golf ball can be picked up easily and surely. Further, the cutout has a width that is greater or equal to a width of the deflectable plate, so that the presence of the cutout enables an increase of a portion of the deflectable plate which is able to deform upwardly. Therefore, it is possible to set the length of the deflectable plate extending into the opening to be extremely short. Accordingly, force pushed by the deflectable plate against a golf ball while a user picks up the golf ball can get lower, which results in a decrease of the possibility of damaging the golf ball.

In the first aspect of the present invention, the golf putter head may further include a support plate that couples the deflectable plate to a bottom surface of the golf putter head. Further, a shape of a portion of the support plate may conform to a portion of the opening.

According to this configuration, the deflectable plate is fixed to the bottom surface of the golf putter head using not an adhesive but the support plate. Therefore, when the deflectable plate is worn out, a user can replace the old deflectable plate with a new plate. Further, from a design perspective, it is preferable that a shape of a portion of the support plate conforms to a shape of a portion of the opening.

In the first aspect of the present invention, the golf putter head may be smaller than an inner diameter of a golf cup.

According to this configuration, it is possible to pick up a golf ball dropped in a golf cup.

In the first aspect of the present invention, the golf putter head may include a first and a second section, with each section extending from the putter face, and each section may be cantilevered from the putter face thereby forming an aperture.

According to this configuration, a user can easily take out a golf ball trapped in the opening through the aperture formed on the golf putter head.

In the first aspect of the present invention, a size of the aperture may be smaller than a diameter of the opening.

According to this configuration, it is possible to stably trap a golf ball in the opening.

In the first aspect of the present invention, the size of the aperture may be not less than 2.0 cm and not more than 3.0 cm.

According to this configuration, since most users can make their fingers get through the aperture, it is possible to easily take out a golf ball. Further, it is possible to stably trap a golf ball in the opening.

In the first aspect of the present invention, the deflectable plate may be made of polyacetal resin or polypropylene.

According to this configuration, if the deflectable plate is used for a long time, elasticity of the deflectable plate can be maintained compared with a deflectable plate made of metal or rubber. Therefore, it is preferable that the deflectable plate is made of polyacetal resin or polypropylene.

In the first aspect of the present invention, the opening may be substantially circular, and a distance from the first end of the deflectable plate to an inner surface of the opening that is substantially opposite to the deflectable plate may be not less than 38.8 mm and not more than 41.8 mm.

According to this configuration, it is possible to smoothly pick up a golf ball when a user picks up the golf ball, and it is also possible to decrease the possibility of dropping a golf ball after picking up the golf ball.

In the first aspect of the present invention, the deflectable plate may be located at a position other than the putter face.

According to this configuration, it is easy to manufacture the golf putter head because the deflectable plate does not need to be fixed to a place such as the putter face where its width is narrow and it is difficult to fix the deflectable plate.

In accordance with a second aspect of the present invention, a golf putter head includes:

a face portion, a first weight portion that extends from a heel side of the face portion and a second weight portion that extends from a toe side of the putter face portion forming an area therebetween. A deflectable tongue piece fixed to any one of the face portion, the first weight portion or the second weight portion, the deflectable tongue piece having an end that protrudes toward the area, and a groove formed on an inner surface of any one of the face portion, the first weight portion or the second weight portion and formed on top of the deflectable tongue piece, the groove having a width that is greater than or equal to a width of the deflectable tongue piece, where the area is sized to receive a golf ball.

According to the second aspect of the present invention, there is a groove formed on top of the deflectable tongue piece. Therefore, the deflectable tongue piece can function well even though sand or a cake of soil intrudes into the area. Accordingly, a golf ball can be picked up easily and surely. Further, the groove has a width that is greater than or equal to a width of the deflectable tongue piece, so that the presence of the groove enables an increase of a portion of the deflectable tongue piece which can deflect upwardly. Therefore, it is possible to set the length of deflectable tongue piece extending into the area to be extremely short. Accordingly, force pushed by the deflectable tongue piece against a golf ball while a user picks up the golf ball can get lower, which results in a decrease of the possibility of damaging the golf ball.

In the second aspect of the present invention, the golf putter head may further include a support plate that couples the deflectable tongue piece to a bottom surface of any one of the face portion, the first weight portion or the second weight portion. Further, a shape of an end of the support plate may be the same as a shape of a corresponding part of any one of the face portion, the first weight portion or the second weight portion.

According to this configuration, the deflectable tongue piece is fixed to the bottom surface of the golf putter head using not an adhesive but the support plate. Therefore, if the deflectable tongue piece is worn out, a user can replace the old deflectable tongue piece with a new deflectable tongue piece. Further, from a design perspective, it is preferable that a shape of a portion of the support plate is the same as a shape of a corresponding part of any one of the face portion, the first weight portion or the second weight portion.

In the second aspect of the present invention, the golf putter head may be smaller than an inner diameter of a golf cup.

According to this configuration, it is possible to pick up a golf ball dropped in a golf cup.

In the second aspect of the present invention, a distance between the first weight portion and the second weight portion may reach a minimum at a distal end of each of the first and second weight portions.

According to this configuration, it is possible to stably trap the golf ball in the area.

In the second aspect of the present invention, the distance between the distal end of each of first weight portion and the second weight portions may be not less than 2.0 cm and not more than 3.0 cm.

According to this configuration, since most users can make their fingers get through between the first weight portion and the second weight, it is possible to easily take out the golf ball. Further, it is possible to stably trap a golf ball in the area.

In the second aspect of the present invention, the deflectable tongue piece may be made of a polyacetal resin or polypropylene.

According to this configuration, if the deflectable tongue piece is used for a long time, elasticity of the deflectable tongue piece can be maintained compared with a deflectable tongue piece made of metal or rubber. Therefore, it is preferable that the deflectable tongue piece is made of polyacetal resin or polypropylene.

In the second aspect of the present invention, the area may be substantially circular, and a distance from the end of the deflectable tongue piece to an inner surface of any one of the face portion, the first weight portion or the second weight portion that is substantially opposite to the deflectable tongue piece may be not less than 38.8 mm and not more than 41.8 mm.

According to this configuration, it is possible to smoothly pick up a golf ball when a user picks up the golf ball, and it is also possible to decrease the possibility of dropping a golf ball after picking up the golf ball.

In the second aspect of the present invention, the deflectable tongue piece may be coupled to the first weight portion or the second weight portion.

According to this configuration, it is easy to manufacture the golf putter head because the deflectable tongue piece does not need to be fixed to a place such as the putter face where its width is narrow and it is difficult to fix the deflectable tongue piece.

DETAILED DESCRIPTION OF INVENTION

FIGS. 1 through 5 show a first embodiment of a golf putter head according to the present invention.

Figure 1:
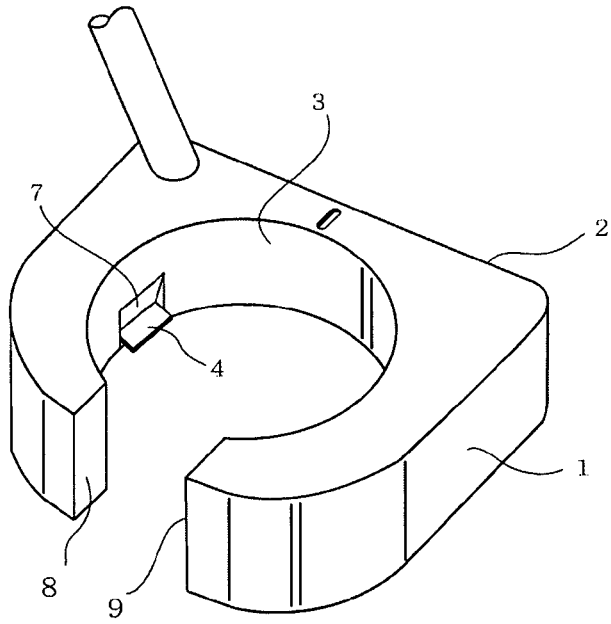
FIG. 1 is a perspective view of a golf putter head of the present invention.

As shown in FIG. 1, an opening 3 is located behind a putter face 2 of a head 1. The opening 3 vertically goes through the head 1 and has a circular shape in which a golf ball can go through. The head 1 does not completely surround the opening 3 so that the head 1 has an aperture behind the face 2. If the opening 3 is completely surrounded by the head 1, it is difficult for a user to take out a golf ball trapped in the opening 3. However, if there is the aperture in a part of the head 1, the user can easily take out the golf ball trapped in the opening 3.

Figure 4:
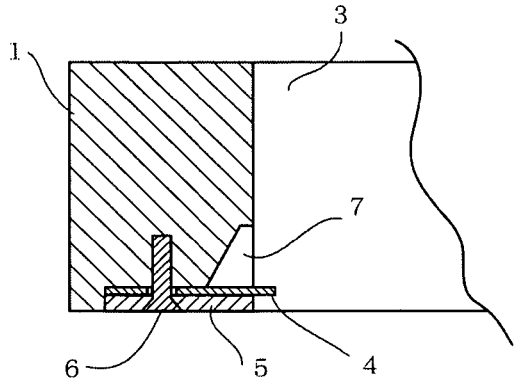
FIG. 4 is an enlarged cross sectional view of a golf putter head of the present invention taken along the line A-A of FIG. 2.
Figure 5:
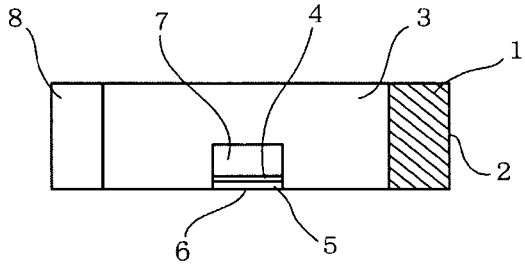
FIG. 5 is a cross sectional view of a golf putter head of the present invention taken along the line B-B of FIG. 2.

As shown in FIGS. 4 and 5, an elastic, deflectable and flat shaped tongue piece 4 is coupled to a bottom part of a lateral portion of the opening 3 using a support plate 5 and a screw 6. The support plate 5 fixes the tongue piece 4 to a bottom surface of the head 1. Since no adhesive, but the support plate is used for fixing the tongue piece 4 to the bottom surface of the head 1, if the tongue piece 4 is worn out, a user can replace the worn-out tongue piece 4 with a new tongue piece. A free end of the tongue piece 4 projects into the opening 3. Above the tongue piece 4, a cutout portion 7 is formed on an inner surface of the opening 3. Further, the cutout portion 7 has a width that is greater than or equal to a width of the tongue piece 4, thereby enabling the tongue piece 4 to easily deflect upwardly. The material for the tongue piece 4 includes elastic resin (plastic), rubber, metal, and the like. Especially, resin such as polyacetal, polypropylene and the like are preferable because such a resin can maintain the elasticity of the tongue piece even after a long term use. Furthermore, polyacetal resin is the most preferable material because its durability is superior to that of polypropylene. In addition, the tongue piece 4 can also have a wire shape using such as a piano wire, or a loop shape, instead of having a flat shape.

Here, the head 1 of the present invention can be perceived to include a face portion, a first weight portion, and a second weight portion. In other words, the face portion, which is a part of the head 1, means a portion which extends from the face surface 2 to a rear portion of the face surface 2 where the opening 3 starts. The first weight portion, which is a part of the head 1, means a portion which cantilevers from a heel side of the face portion in an opposite direction of the face surface 2. Further, the second weight portion, which is a part of the head 1, means a portion which cantilevers from a toe side of the face portion in an opposite direction of the face surface 2. Incidentally, the heel side means a side of the face portion where a shaft is fixed, therefore, in FIG. 2, the left side of the drawing means the heel side. In addition, the toe side means a side of the face portion where a shaft is not fixed, therefore, in FIG. 2, the right side of the drawing means the toe side.

Accordingly, the opening 3 of the present invention is an area surrounded by the face portion, first weight portion, and second weight portion. Further, this area has a size where a golf ball can go through. In other words, it can be said that this area has a size where a golf ball can be received. In addition, the cutout portion 7 is formed on an inner surface of the face portion, the first weight portion or the second weight portion.

Figure 2:
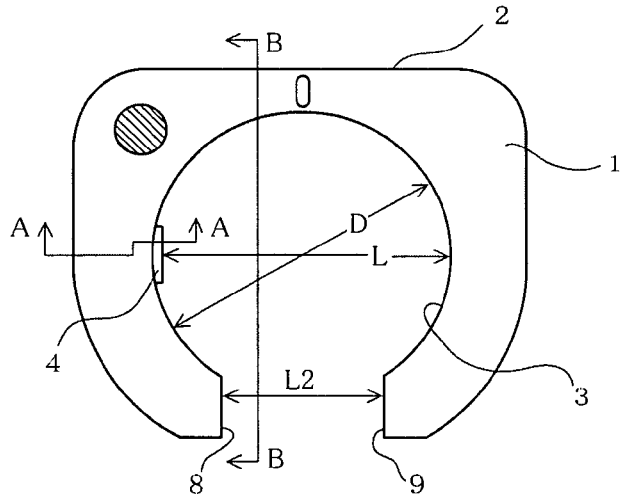
FIG. 2 is a top plan view of a golf putter head of the present invention.
Figure 3:
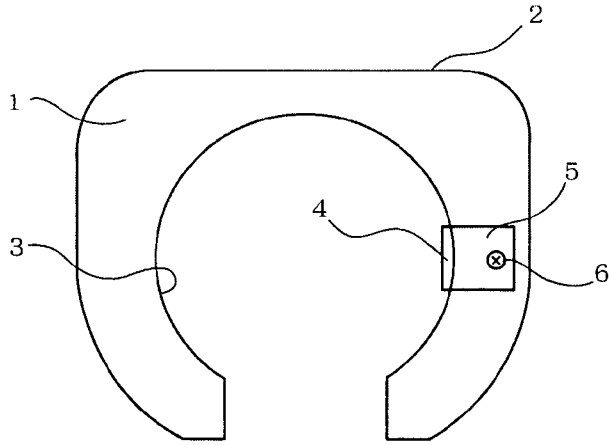
FIG. 3 is a bottom plan view of a golf putter head of the present invention.

As shown in FIG. 2, diameter D of the opening 3 is slightly bigger than diameter of a golf ball, and length L from an end surface of the opening 3 to the tongue piece 4 is slightly smaller than the diameter of the golf ball. In other words, the length L is a distance from an end portion near the opening 3 of the tongue piece 4 to an inner surface of the opening 3 which is opposite the side of an inner surface of the opening 3 to which the tongue piece is fixed. In addition, a distance L2 between both end portions 8 and 9 of the head 1 is smaller than the diameter D of the opening 3. Therefore, it is possible to stably trap the golf ball in the opening. Incidentally, because the distance L2 is smaller than the diameter D of the opening 3, a distance between the first and second weight portions reaches a minimum at the farthest portions from the face surface 2. In addition, it can be also said that the distance L2 is a distance between the distal ends of each of the first and second weight portions from the face surface 2.

In addition, it is preferable that the distance L2 is not less than 2.0 cm. If the distance is not less than 2.0 cm, most people can make their fingers get through the distance, which enables a person to easily take out a golf ball trapped in the opening. Further, it is more preferable that the distance L2 is not more than 3.0 cm because it becomes difficult to surely trap a golf ball in the opening if the distance L2 is bigger than 3.0 cm. In the present embodiment, L2 is set to 2.9 cm.

In addition, it is preferable that the size of the head 1 is smaller than the inner diameter of the golf cup. That is, it is preferable that the longest distance among widths of the profile of the head 1 shown in the plan view in FIG. 2 is smaller than the inner diameter of the golf cup. Accordingly, it is possible to pick up a golf ball even though the golf ball is positioned in the golf cup.

Incidentally, golf rules provide that the inner diameter of a golf cup is 10.8 cm (4.25 inches). Therefore, it is preferable that the longest distance among widths of the profile of the head 1 is smaller than 10.8 cm.

Further, the golf rules provide that the diameter of a golf ball should be greater or equal to 1.680 inches (42.67 mm). Most of the commercially available golf balls are about 42.8 mm in diameter. Therefore, it is preferable that the diameter D of the opening 3 is greater or equal to 43 mm. In the present embodiment, the diameter D of the opening 3 is set to 43.0 mm.

Next, the length L will be explained. As described above, it is necessary that the length L is slightly smaller than the diameter of the golf ball. Concretely, it is preferable that the difference between the diameter of the golf ball and the length L is not less than 1 mm and not more than 4 mm. In a case where the difference is less than 1 mm, there is a risk that the golf ball which is once trapped in the opening 3 can drop through the opening 3. Further, in a case where the difference is more than 4 mm, the tongue piece 4 is too strongly pushed toward the golf ball while the golf ball is picked up. Therefore, it becomes difficult to smoothly pick up the golf ball. In addition, since a load added to the tongue piece 4 becomes bigger, the tongue piece is easily worn out. Here, when the diameter of general golf balls is thought to be 42.8 mm, the length L is preferably not less than 38.8 mm and not more than 41.8 mm. In the present embodiment, the length L is set to 40.5 mm, and the difference from the diameter of general golf balls is set to 2.3 mm.

In addition, the opening 3 in the present embodiment has a circular shape, but the opening 3 does not necessarily have the circular shape. However, in a case where the opening 3 has other shapes than the circular shape, the opening 3 needs to be bigger than a golf ball. In other words, the opening 3 is necessary to have a size where a golf ball can get through. Concretely, the opening 3 needs to have a size where a sphere 42.8 mm in diameter, that is a general golf ball size, can go through.

Above the tongue piece 4, as shown in FIG. 4, there is the cutout portion 7 which allows the tongue piece 4 to deform upwardly. Therefore, the free length from a fix portion of the tongue piece 4 to the free end can be secured. That is, the presence of the cutout portion 7 enables an increase in the portion of the tongue piece 4 that can deflect upwardly. Therefore, it is possible to set the length of the tongue piece 4 extending into the opening 3 to be extremely short. Further, during picking up a golf ball, the force pushed by the tongue piece 4 to a golf ball gets lower, thereby reducing the chance of damaging the golf ball. Because of the cutout portion 7, the tongue piece 4 can work well even when sand or a cake of soil intrudes into the opening 3, thereby enabling a person to pick up a golf ball easily and surely. In addition, from a design perspective, it is preferable that a shape of a free end of the support plate 5 is the same as a shape of a corresponding part of the opening 3. Concretely, from the point of design, the outer end shape of the support plate 5 is preferably aligned with a circular arc of the opening 3 which is positioned right over the support plate 5.

In a case where the shape of the opening 3 is circular, the tongue piece 4 can be positioned anywhere as long as the position is in the opening 3, and the number of the tongue piece 4 can be one or more than one. However, a portion right behind the face surface of the head 1 has such a narrow width that it is difficult to fix the tongue piece 4 to the portion right behind the face surface. Therefore, it is preferable to fix the tongue piece 4 to the heel side or the toe side in the opening 3. In other words, it is preferable to fix the tongue piece 4 to the first weight portion or the second weight portion.

Figure 6:
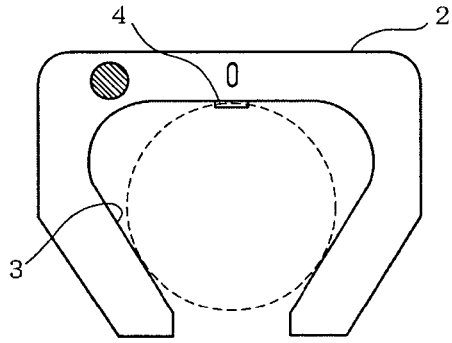
FIG. 6 is a second embodiment of a shape of an opening.
Figure 7:
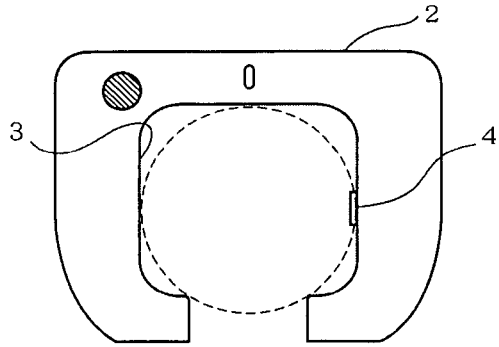
FIG. 7 is a third embodiment of a shape of an opening.

Next, the operation of picking up a golf ball using the putter head of the present invention will be explained. By positioning the opening 3 of the head right over a golf ball on a green, and pushing the head toward the golf ball, the tongue piece 4 makes elastic deformation in the cutout portion 7 due to the golf ball passing. Once the golf ball passes, the tongue piece 4 returns to the original position, therefore, the tongue piece 4 supports the golf ball. Then, the ball is trapped in the opening 3. By pulling up the putter, a player can pick up the golf ball while standing. The player does not need to bend over. In addition, when the distance L2 between the both ends 8 and 9 of the head 1 is set to be the length where people can pass their fingers through, it becomes easy to take out a golf ball. Further, when the size of the head 1 is formed smaller than the size of a golf cup, it is possible to pick up a golf ball dropped in the cup. Furthermore, the opening 3 can take other shapes than a circular one. FIG. 6 shows a second embodiment of the opening 3, and FIG. 7 shows a third embodiment of the opening 3.

As described above, the preferable embodiments of the present invention are explained with reference to the attached drawings, however, the present invention is not limited to those embodiments. It is understood that those skilled in the art can conceive various changes or modifications in the scope described in what is claimed, and that those changes and modifications also belong to the technical scope of the present invention.

The invention claimed is:

1. A golf putter head comprising:

an opening located behind a putter face, the opening larger than a golf ball;

a deflectable plate coupled to the golf putter head, with a first end of the deflectable plate projecting into the opening; and a cutout located above the deflectable plate, the cutout having a width that is greater than or equal to a width of the deflectable plate.

2. The golf putter head of claim 1, further comprising:

a support plate that couples the deflectable plate to a bottom surface of the golf putter head.

3. The golf putter head of claim 2, wherein a shape of a portion of the support plate conforms to a portion of the opening.

4. The golf putter head of claim 1, wherein the golf putter head is smaller than an inner diameter of a golf cup.

5. The golf putter head of claim 1, wherein the golf putter head includes a first and a second section, with each section extending from the putter face, and each section is cantilevered from the putter face thereby forming an aperture.

6. The golf putter head of claim 5, wherein a size of the aperture is smaller than a diameter of the opening.

7. The golf putter head of claim 5, wherein the size of the aperture is not less than 2.0 cm and not more than 3.0 cm.

8. The golf putter head of claim 1, wherein the deflectable plate is made of polyacetal resin or polypropylene.

9. The golf putter head of claim 1, wherein the opening is substantially circular, and a distance from the first end of the deflectable plate to an inner surface of the opening that is substantially opposite to the deflectable plate is not less than 38.8 mm and not more than 41.8 mm.

10. The golf putter head of claim 1, wherein the deflectable plate is located at a position other than the putter face.

11. A golf putter head comprising:

a face portion, a first weight portion that extends from a heel side of the face portion and a second weight portion that extends from a toe side of the putter face portion forming an area therebetween;

an deflectable tongue piece fixed to any one of the face portion, the first weight portion or the second weight portion, the deflectable tongue piece having an end that protrudes toward the area; and a groove formed on an inner surface of any one of the face portion, the first weight portion or the second weight portion and formed above the deflectable tongue piece, the groove having a width that is greater than or equal to a width of the deflectable tongue piece;

wherein the area is sized to receive a golf ball.

12. The golf putter head of claim 11, further comprising:

a support plate that couples the deflectable tongue piece to a bottom surface of any one of the face portion, the first weight portion or the second weight portion.

13. The golf putter head of claim 12, wherein a shape of an end of the support plate is the same as a shape of a corresponding part of any one of the face portion, the first weight portion or the second weight portion.

14. The golf putter head of claim 11, wherein the golf putter head is smaller than an inner diameter of a golf cup.

15. The golf putter head of claim 11 wherein a distance between the first weight portion and the second weight portion reaches a minimum at a distal end of each of the first and second weight portions.

16. The golf putter head of claim 11, wherein the distance between the distal end of each of first weight portion and the second weight portions is not less than 2.0 cm and not more than 3.0 cm.

17. The golf putter head of claim 11, wherein the deflectable tongue piece is made of a polyacetal resin or polypropylene.

18. The golf putter head of claim 11, wherein the area is substantially circular, and a distance from the end of the deflectable tongue piece to an inner surface of any one of the face portion, the first weight portion or the second weight portion that is substantially opposite to the deflectable tongue piece is not less than 38.8 mm and not more than 41.8 mm.

19. The golf putter head of claim 11, wherein the deflectable tongue piece is coupled to the first weight portion or the second weight portion.

* * * * *